US006235690B1

(12) United States Patent
Shibayama et al.

(10) Patent No.: US 6,235,690 B1
(45) Date of Patent: May 22, 2001

(54) UREA THICKENED CARBONATE ESTER GREASE COMPOSITION

(75) Inventors: Atushi Shibayama; Hiroshi Kimura; Youichiro Sugimori; Masao Yamamoto, all of Fujisawa (JP)

(73) Assignees: Kyodo Yushi Co., Ltd., Tokyo; NSK Ltd., Fujisawa, both of (JP)

( * ) Notice: Subject to any disclaimer, the term of this patent is extended or adjusted under 35 U.S.C. 154(b) by 0 days.

(21) Appl. No.: 09/348,292

(22) Filed: Jul. 7, 1999

(30) Foreign Application Priority Data

Jul. 7, 1998 (JP) ..... 10-191143

(51) Int. Cl.[7] ..... C10M 105/48
(52) U.S. Cl. ..... 508/462; 508/552
(58) Field of Search ..... 508/462, 552

(56) References Cited

U.S. PATENT DOCUMENTS 2,651,657 * 9/1953 Mikeska et al. .
2,739,127 * 3/1956 Morway et al. .
5,290,464 * 3/1994 Fisicaro et al. .
5,505,869 * 4/1996 Berti et al. .

FOREIGN PATENT DOCUMENTS 8-034987 2/1996 (JP) .
9-316480 12/1997 (JP) .

* cited by examiner

*Primary Examiner*—Jerry D. Johnson
(74) *Attorney, Agent, or Firm*—Oblon, Spivak, McClelland, Maier & Neustadt, P.C.

(57) ABSTRACT

An improved lubricating grease composition is herein disclosed, which comprises a base oil and a thickening agent, wherein the base oil comprises 50 to 100% by weight of a carbonate ester compound represented by the following general formula (I):

$$R^1O—CO—OR^2 \quad (I)$$

wherein $R^1$ and $R^2$ each independently represents a saturated or unsaturated, linear or branched alkyl group having 6 to 30 carbon atoms, on the basis of the total weight of the base oil. The lubricating grease composition shows remarkably improved acoustic life and an improved frictional coefficient, as compared with those observed for conventional grease compositions.

6 Claims, No Drawings

UREA THICKENED CARBONATE ESTER GREASE COMPOSITION

BACKGROUND OF THE INVENTION

The present invention relates to a lubricating grease composition and in particular to a lubricating grease composition for ball bearings.

As the grease for bearings, in particular, ball bearings conventionally used in spindle motors for, for instance, hard disks of computers and recording devices such as CD-R's, there has been used, for instance, those comprising a base oil such as dioctyl sebacate or a pentaerythritol ester; and a thickening agent such as lithium stearate or lithium hydroxy stearate. However, the acoustic life of the bearing has recently become insufficient because of the improvement of bearing precision due to an increase in the recording density and because of the requirement for a higher use temperature of such devices due to an increase in the number of revolution.

SUMMARY OF THE INVENTION

Accordingly, it is an object of the present invention to provide a lubricating grease composition whose frictional coefficient is lower than those observed for conventional grease compositions and which can ensure a long acoustic life when applied to bearings and, in particular, to a lubricating grease composition suitably used for ball bearings.

The inventors of this invention have conducted various studies to solve the foregoing problems associated with the conventional grease compositions for bearings, have found that it is effective to use a specific carbonate ester compound as a part or the whole of the base oil component in a lubricating grease composition which comprises a base oil and a thickening agent and have thus completed the present invention based on this finding.

According to the present invention, there is provided a lubricating grease composition which comprises a base oil and a thickening agent, wherein the base oil comprises 50 to 100% by weight of a carbonate ester compound represented by the following general formula (I):

$$R^1O—CO—OR^2 \quad (I)$$

wherein $R^1$ and $R^2$ each independently represents a saturated or unsaturated, linear or branched alkyl group having 6 to 30 carbon atoms, on the basis of the total weight of the base oil.

In preferred embodiments of the grease composition of the present invention, the thickening agent is preferably at least one member selected from the group consisting of lithium soaps, sodium soaps, calcium soaps, aluminum soaps, complex soaps thereof and urea compounds.

The lubricating grease composition of the present invention is suitably used as a lubricating grease composition for ball bearings of, in particular, spindle motors.

DESCRIPTION OF THE PREFERRED EMBODIMENTS

The carbonate ester compound represented by Formula (I) and used as a part or the whole of the base oil component according to the present invention is preferably those represented by Formula (I) wherein the substituents $R^1$ and $R^2$ each independently represents a saturated or unsaturated, branched alkyl group having 7 to 25 carbon atoms. Examples of preferred branched alkyl groups include those represented by the formula: $—CH_2CHR^3R^4$. In this Formula, $R^3$ represents a saturated linear alkyl group having 1 to 7 carbon atoms and $R^4$ represents a saturated linear alkyl group having 4 to 12 carbon atoms. Particularly preferred are those represented by Formula (I) wherein the total carbon atom number of $R^3$ and $R^4$ ranges from 11 to 13. In the lubricating grease composition of the present invention, the carbonate ester compound of Formula (I) is used in an amount ranging from 50 to 100% by weight, preferably 60 to 100% by weight and more preferably 70 to 100% by weight based on the total weight of the base oil.

As the base oil which can be used in combination with the carbonate ester compound of Formula (I), there may be listed, for instance, ester type synthetic oils such as polyol ester oils, ether type synthetic oils such as alkyl diphenyl ethers, synthetic hydrocarbon oils such as poly-α-olefins, mineral oils such as paraffinic mineral oils.

The thickening agent used in the present invention is preferably selected from the group consisting of lithium soaps, sodium soaps, calcium soaps, aluminum soaps, complex soaps thereof and urea compounds. Particularly preferred are lithium soaps such as lithium stearate and lithium 12-hydroxystearate. Examples of urea type thickening agents are, for instance, aliphatic or alicyclic diurea compounds and polyurea compounds.

The amount of the thickening agent used in the grease composition preferably ranges from 3 to 30% by weight and more preferably 5 to 25% by weight based on the total weight of the grease composition.

The grease composition of the present invention may further comprise additives commonly used in this field such as an antioxidant, a rust proof agent and/or an anticorrosive agent, in addition to the foregoing essential components.

As has been described above in detail, the lubricating grease composition of the present invention can not only ensure a frictional coefficient substantially lower than those expected by the use of the conventional grease compositions, but also ensure a substantially improved acoustic life, because of the use of a novel base oil component, i.e., a carbonate ester compound of Formula (I).

The lubricating grease composition of the present invention will hereinafter be described in more detail with reference to the following Examples and Comparative Examples, but the present invention is not restricted to these specific Examples at all.

EXAMPLE 1 AND COMPARATIVE EXAMPLE 1

A grease composition was prepared by adding, with stirring, each thickening agent listed in the following Table 1 to each base oil likewise listed in Table 1. In Table 1, the numerical values listed in the columns of the grease components are expressed in terms of "part by weight" unless otherwise specified. The resulting grease composition each was inspected for worked penetration and the acoustic life. The results thus obtained are summarized in Table 1. In this connection, the acoustic life was determined and evaluated by the following method and criteria.

Test for Acoustic Life

Bearing: ball bearings having an inner diameter of 5 mm, an outer diameter of 9 mm and a width of 4 mm;

Amount of Sealed Grease: 10 mg;

Number of Revolution of Outer Ring: 12,000 rpm;

Temperature of Atmosphere: 70° C.;

AxialLoad: 2 kgf.

Method for Evaluation:

The accelerated vibration values (G values) of ball bearings were evaluated according to the following criteria before and after a continuous rotation test over 2,000 hours:

◎: The G value observed after the test was almost identical to that observed before the test.

○: The G value observed after the test was not more than 1.5 times that observed before the test.

Δ: The G value observed after the test was not more than 2.0 times that observed before the test.

×: The G value observed after the test was more than 2.0 times that observed before the test.

| Ex. No. | 1 | 2 | 3 | 4 | 5 | 6 | 7 | 1* | 2* | 3* |
|---|---|---|---|---|---|---|---|---|---|---|
| Base Oil | | | | | | | | | | |
| Carbonate Ester(1) | 90 | 66 | 88 | 85 | 85 | 53 | 60 | 60 | 20 | — |
| PET(2) | — | 22 | — | — | — | 22 | 23 | 8 | 70 | 90 |
| Thickening Agent | | | | | | | | | | |
| Li(12 OH)St(3) | 10 | — | 6 | 15 | — | — | — | — | 10 | 10 |
| LiSt(4) | — | 12 | 6 | — | — | — | — | 32 | — | — |
| Aliphatic Diurea | — | — | — | — | 15 | — | — | — | — | — |
| Aromatic Diurea | — | — | — | — | — | 25 | — | — | — | — |
| Alicyclic Diurea | — | — | — | | — | — | 17 | — | — | — |
| Worked penetration | 241 | 310 | 263 | 214 | 255 | 238 | 235 | 152 | 248 | 252 |
| Acoustic Life | ⊙ | ○ | ⊙ | ⊙ | ⊙ | ○ | ○ | × | Δ | Δ |

*: Comparative Example (1)RO—CO—OR' (wherein R and R' each represents a group; $—CH_2CHR^3R^4$, $R^3$ represents a saturated linear alkyl group having 1 to 7 carbon atoms and $R^4$ represents a saturated linear alkyl group having 4 to 12 carbon atoms, provided that the sum of the carbon atom numbers of $R^3$ and $R^4$ ranges from 11 to 13) (Kinematic viscosity as determined at 40° C.: 18 $mm/s^2$).

(2)PET: Pentaerythritol ester (Kinematic viscosity as determined at 40° C.: 32 $mm/s^2$).

(3)Li(12 OH)St: Lithium 12-hydroxystearate.

(4)LiSt: Lithium stearate.

The results listed in the foregoing Table 1 clearly indicate that the lubricating grease composition of the present invention is excellent in the acoustic life as compared with that observed for the conventional grease comprising, as the base oil, pentaerythritol ester oil.

What is claimed is:

1. A lubricating grease composition which comprises a base oil and a urea compound as a thickening agent, wherein said base oil comprises 50 to 100% by weight of a carbonate ester compound on the basis of the total weight of the base oil, said carbonate ester compound being represented by the following general formula (I):

$$R^1O—CO—OR^2 \quad (I)$$

wherein $R^1$ and $R^2$ each independently represents a saturated or unsaturated, linear or branched alkyl group having 6 to 30 carbon atoms, and wherein the amount of said urea compound ranges from 3 to 30% by weight on the basis of the total weight of the grease composition.

2. The grease composition of claim 1 wherein said $R^1$ and $R^2$ each independently represents a saturated or unsaturated, branched alkyl group having 7 to 25 carbon atoms.

3. The grease composition of claim 2 wherein said branched alkyl group is represented by $—CH_2CHR^3R^4$, and wherein said $R^3$ is represented by a saturated linear alkyl group having 1 to 7 carbon atoms and said $R^4$ is represented by a saturated linear alkyl group having 4 to 12 carbon atoms, provided that the total carbon atom number of $R^3$ and $R^4$ ranges from 11 to 13.

4. The grease composition of claim 1 wherein the amount of said carbonate ester compound ranges 60 to 100% by weight on the basis of the total weight of the base oil.

5. The grease composition of claim 1 wherein the amount of said carbonate ester compound ranges 70 to 100% by weight on the basis of the total weight of the base oil.

6. The grease composition of claim 1 wherein the amount of said urea compound ranges from 5 to 25% by weight on the basis of the total weight of the grease composition.

* * * * *